US010217323B2

(12) United States Patent
Watkins et al.

(10) Patent No.: US 10,217,323 B2
(45) Date of Patent: Feb. 26, 2019

(54) GAMING MACHINE, SYSTEM, AND METHOD WITH MULTIPLE REEL SET CONTROL

(71) Applicants: Brian Watkins, Austin, TX (US); Andrea R. Barton, Austin, TX (US)

(72) Inventors: Brian Watkins, Austin, TX (US); Andrea R. Barton, Austin, TX (US)

(73) Assignee: Everi Games, Inc., Austin, TX (US)

( * ) Notice: Subject to any disclaimer, the term of this patent is extended or adjusted under 35 U.S.C. 154(b) by 392 days.

(21) Appl. No.: 14/866,917

(22) Filed: Sep. 26, 2015

(65) Prior Publication Data

US 2017/0092074 A1 Mar. 30, 2017

(51) Int. Cl.
*G07F 17/34* (2006.01)
*G07F 17/32* (2006.01)

(52) U.S. Cl.
CPC ..... *G07F 17/3276* (2013.01); *G07F 17/3209* (2013.01); *G07F 17/3211* (2013.01); *G07F 17/34* (2013.01)

(58) Field of Classification Search
CPC ..... G07F 17/32; G07F 17/34; G07F 17/3276; G07F 17/3211; G07F 17/3209
See application file for complete search history.

(56) References Cited

U.S. PATENT DOCUMENTS 6,394,902 B1 * 5/2002 Glavich ..... G07F 17/3244 273/143 R
2002/0039923 A1 * 4/2002 Cannon ..... G07F 17/32 463/42
2008/0268946 A1 * 10/2008 Roemer ..... G07F 17/32 463/27
2010/0120522 A1 * 5/2010 Englman ..... G07F 17/3258 463/26
2010/0137052 A1 * 6/2010 Bennett ..... G07F 17/32 463/16

* cited by examiner

*Primary Examiner* — Omkar Deodhar
*Assistant Examiner* — Shauna-Kay Hall
(74) *Attorney, Agent, or Firm* — The Culbertson Group, P.C.

(57) ABSTRACT

A gaming machine includes a display system, player input system, and processor programmed or otherwise operable to perform a number of operations through the gaming machine hardware to provide a player-interactive feature. The gaming machine operates in a base game state in which a base set of symbol locations is populated with symbols responsive to a play initiation input from the player input system. The gaming machine is also controlled to activate a bonus input device while the gaming machine is in the base game state, and to place the gaming machine in a bonus state in response to a player actuation of the activated bonus input device. In response to a play initiation input while the gaming machine is in the bonus game state, two or more bonus game sets of symbol locations are populated with game symbols for that respective play initiation input.

20 Claims, 8 Drawing Sheets

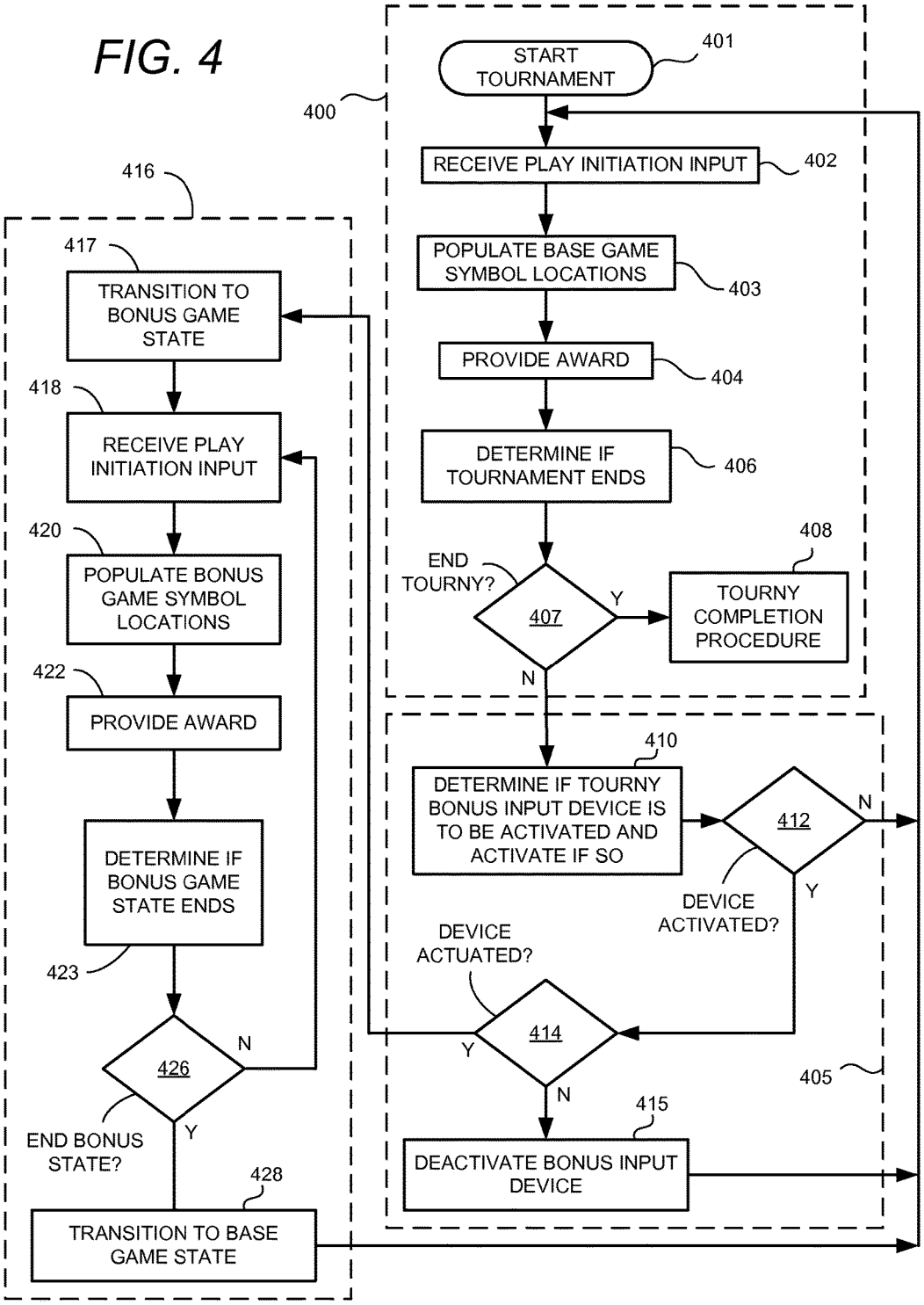
FIG. 4
400
START TOURNAMENT
401
RECEIVE PLAY INITIATION INPUT
402
POPULATE BASE GAME SYMBOL LOCATIONS
403
PROVIDE AWARD
404
DETERMINE IF TOURNAMENT ENDS
406
END TOURNY?
407
Y
N
TOURNY COMPLETION PROCEDURE
408
DETERMINE IF TOURNY BONUS INPUT DEVICE IS TO BE ACTIVATED AND ACTIVATE IF SO
410
412
DEVICE ACTIVATED?
DEVICE ACTUATED?
414
405
DEACTIVATE BONUS INPUT DEVICE
415
416
TRANSITION TO BONUS GAME STATE
417
RECEIVE PLAY INITIATION INPUT
418
POPULATE BONUS GAME SYMBOL LOCATIONS
420
PROVIDE AWARD
422
DETERMINE IF BONUS GAME STATE ENDS
423
426
END BONUS STATE?
TRANSITION TO BASE GAME STATE
428

GAMING MACHINE, SYSTEM, AND METHOD WITH MULTIPLE REEL SET CONTROL

TECHNICAL FIELD OF THE INVENTION

The present invention relates to gaming machines and gaming machine systems which can vary the number of sets of reels activated for a given play in the game, particularly in a competition conducted with a number of different gaming machines.

BACKGROUND OF THE INVENTION

Reel-type gaming machines in which the results of a play in the game are shown via a set of game symbols appearing on mechanical or video-simulated reels are popular both for individual play and for competitions such as tournaments. However, particularly in a tournament setting, where the common strategy is to simply play the game as quickly as possible to increase the number of opportunities for winning plays, play may be seen as monotonous and uninteresting. It is therefore desirable to provide reel-type games which maintain the player's interest during play by providing interesting and attractive graphics, enhanced audio, and additional features such as bonus or feature games which are entered through a primary game. In particular, reel-type games may incorporate features which allow increased player interaction to provide an actual or implied improvement in game results.

U.S. Pat. No. 8,602,887, discloses a tournament gaming machine which provides a player-interactive feature for a tournament game. The player-interactive feature allows the player to interact with transient touchscreen graphics to reveal bonus points which increase the player's tournament score. The player inputs in addition to simply initiating game plays as rapidly as possible help make the game more interesting to the players.

There remains a need in the gaming industry for gaming machines and systems which include features to help make the games more interesting and enjoyable for both individual and competitive play.

SUMMARY OF THE INVENTION

The present invention includes a gaming machine which provides a player-interactive feature which selectively changes the number of reel sets which are active for a given play in the game. The invention encompasses gaming machines, gaming methods, and program products which may be used in gaming machines to provide the player-interactive, reel set modifying feature.

A gaming machine according to one embodiment of the invention includes a display system, a player input system, and at least one processor. The at least one processor in this embodiment is programmed or otherwise operable to perform a number of operations to control the display system so as to vary the number of reel sets from a base set of symbol locations for some plays in the game to multiple sets of symbol locations for other plays. In particular, the gaming machine is adapted to operate in a base game state in which the display system is controlled to populate a base set of symbol locations with game symbols responsive to a play initiation input from the player input system. The displayed game symbols for the respective play initiation input correspond to a respective result in the game for the respective play initiation input. The gaming machine is also controlled to activate a bonus input device while the gaming machine is in the base game state, and to place the gaming machine in a bonus state in response to a player actuation of the activated bonus input device. In response to a play initiation input through the player input system while the gaming machine is in the bonus game state, the display system is controlled to populate two or more bonus game sets of symbol locations with game symbols for that respective play initiation input. The game symbols in each bonus set of symbol locations correspond to a respective result in the game for the respective play initiation input. A suitable arrangement is also included in the gaming machine for providing an award corresponding to each result in the game for a respective play initiation input in the game, both results shown in the base game state and in the bonus game state.

As used in this disclosure and the accompanying claims the term "populate" with reference to a set of symbol locations refers to modifying the given display device so that game symbols defined for the game are displayed in the symbol locations to represent a result in the game. Examples of this symbol location populating process will be described further below in connection with the drawings.

As will be described further below, some embodiments of the invention have particular application to gaming machines operating in a competition or tournament mode. As used in this disclosure and the accompanying claims, a "tournament game" refers to a game in which multiple gaming machines are operating in a competition mode in which the players operating the gaming machines compete according to some metric. The metric may be a score produced via operation of the respective gaming machine. Such a "tournament game" may be an in revenue game in which wagers are required or an out of revenue game in which individual plays in the game are not associated with a wager.

The display system of the gaming machine may include either mechanical or video simulated reels to produce the base set of symbol locations and may include additional mechanical or video simulated reels for the bonus sets of symbol locations. In some cases the base reel set (that is, the reels defining the base set of symbol locations) remains active during the bonus game state and represents one of the two or more bonus reel sets (that is, the reels defining a bonus set of symbol locations). In any event, the gaming machine may be adapted to transition back to the base game state after a certain period of time in the bonus game state, after a certain number of play activations, or in any other suitable fashion.

The invention further includes methods for providing multiple reel set control. These methods implement the gaming machine functions described above. Also, because the gaming machine may be implemented using a general purpose processing device to direct the various functions described above and in more detail below, the invention also encompasses a program product comprising non-transitory storage media storing program code which is executable to direct the various gaming machine functions. Methods and program products according to the invention, along with additional features of the invention will be described in detail below in connection with the drawings.

BRIEF DESCRIPTION OF THE DRAWINGS

FIG. 4 is a flow diagram illustrating process steps according to one example embodiment of the present invention.

DESCRIPTION OF ILLUSTRATIVE EMBODIMENTS

In the following description, FIGS. 1-3 will be used to describe example gaming machines and gaming networks through which the present invention may be implemented. Processes which are illustrative of various embodiments of the invention will then be described in connection with the flow chart of FIG. 4. FIGS. 5 through 8 will be used to describe various graphic game presentations which may be generated according to embodiments of the present invention.

Figure 1:
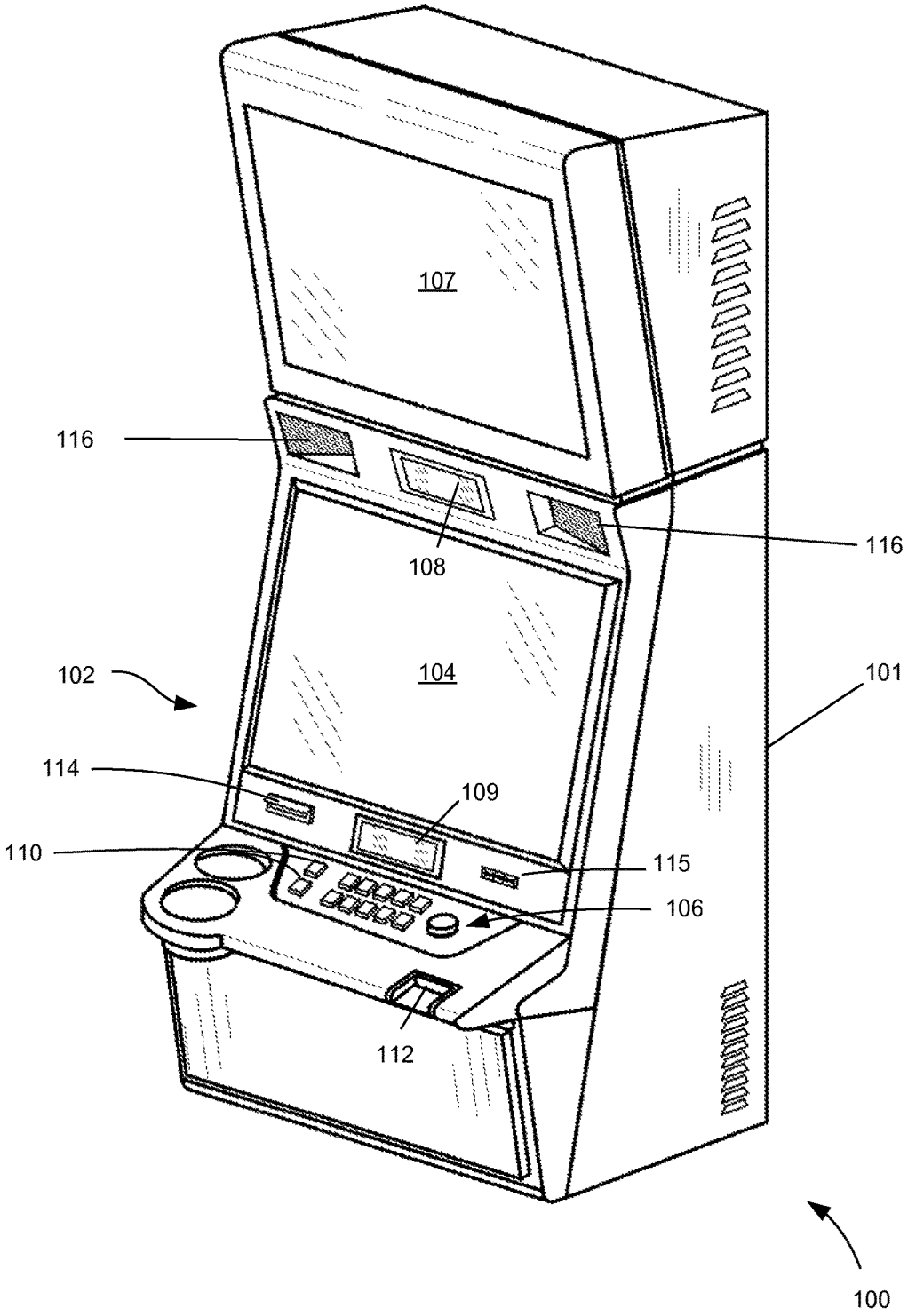
FIG. 1 is a view in perspective of a gaming machine which may be employed to implement various embodiments of the present invention.

FIG. 1 shows a gaming machine 100 that may be used in implementing a wagering game utilizing a multiple reel set feature according to certain embodiments of the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, with a button panel 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display graphics used to display symbol location sets and other elements according to the present invention. As will be described further below in connection with FIG. 2 and elsewhere, it is also possible for gaming machines within the scope of the present invention to include mechanical elements such as mechanical reels. In these mechanical reel implementations, the mechanical reels may be used to display the symbol location sets. Generally, the display device or display devices of the gaming machine, whether video display devices, mechanical devices, or combinations of the two, which are used to display graphic elements according to embodiments of the invention may be described in this disclosure and the accompanying claims as a "display system."

The gaming machine 100 illustrated for purposes of example in FIG. 1 also includes a number of mechanical control buttons 110 mounted on button panel 106. These control buttons 110 may allow a player to select a bet level, select paylines, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls included on button panel 106. The player interface devices which receive player inputs in the course of a game played through the gaming machine, such as controls to select a wager amount for a given play, controls to enter a play input to actually start a given play in the wagering game or tournament game, or controls to allow a player to make other player selections in a game according to the present invention, may be referred to generally as a "player input system."

It will be appreciated that gaming machines may also include a number of other player interface devices in addition to devices that are considered player controls for use in entering inputs in the course of a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

Figure 2:
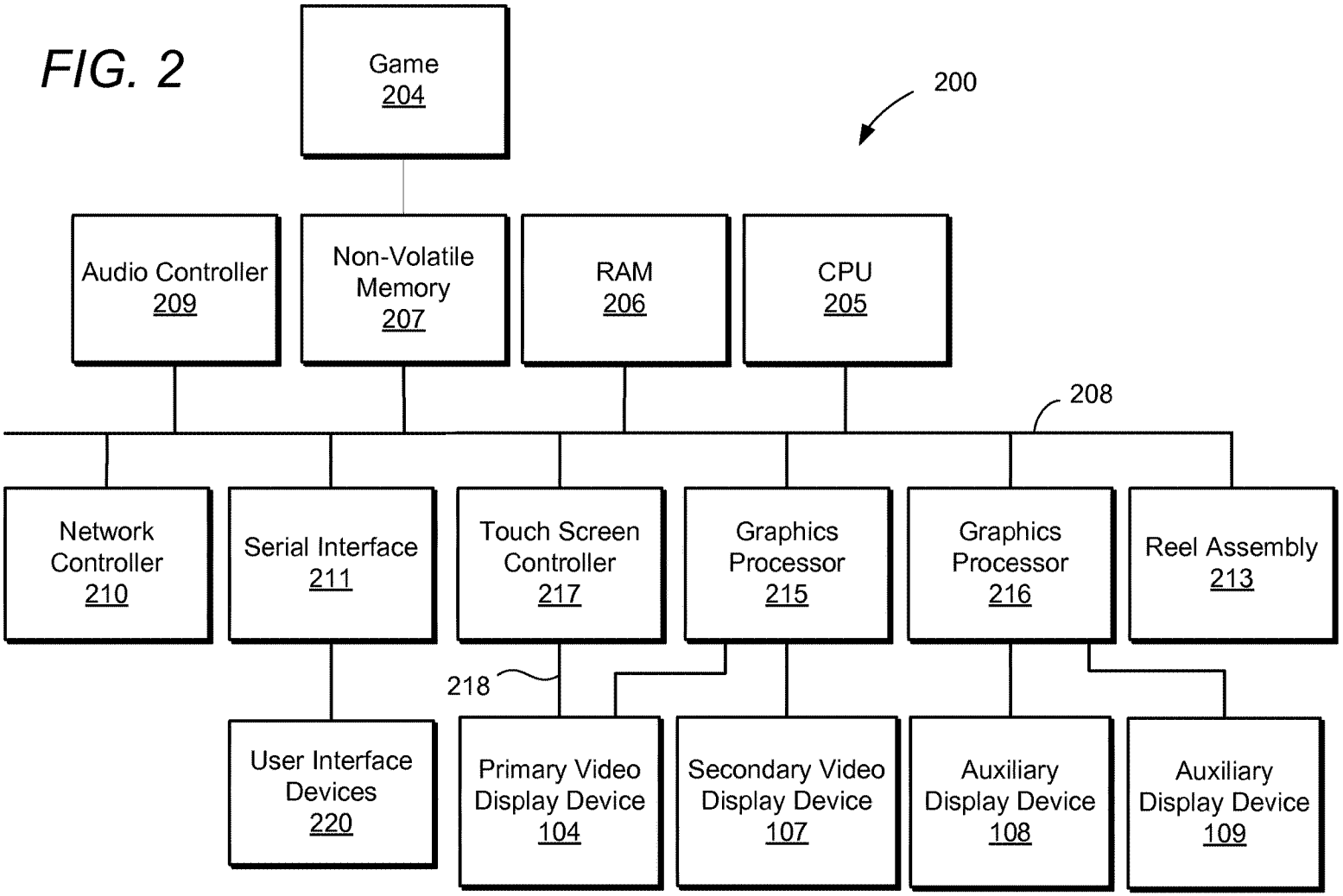
FIG. 2 is a diagrammatic representation of the gaming machine shown in FIG. 1 showing various components of the gaming machine.

FIG. 2 shows a logical and hardware block diagram 200 of gaming machine 100 which includes a processor (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on (or connected to) a standard personal computer motherboard and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG. 1). Thus the designation "gaming machine" encompasses both a stand-alone gaming machine and a gaming machine (that is, the part housed in a cabinet such as cabinet 101 in FIG. 1) along with one or more remote components for providing various functions (such as generating outcomes for plays in a game, and driving display devices mounted in the gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as program code 204 (which may include the game program code and award program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the present invention may include mechanical reels. For example, a number of sets of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
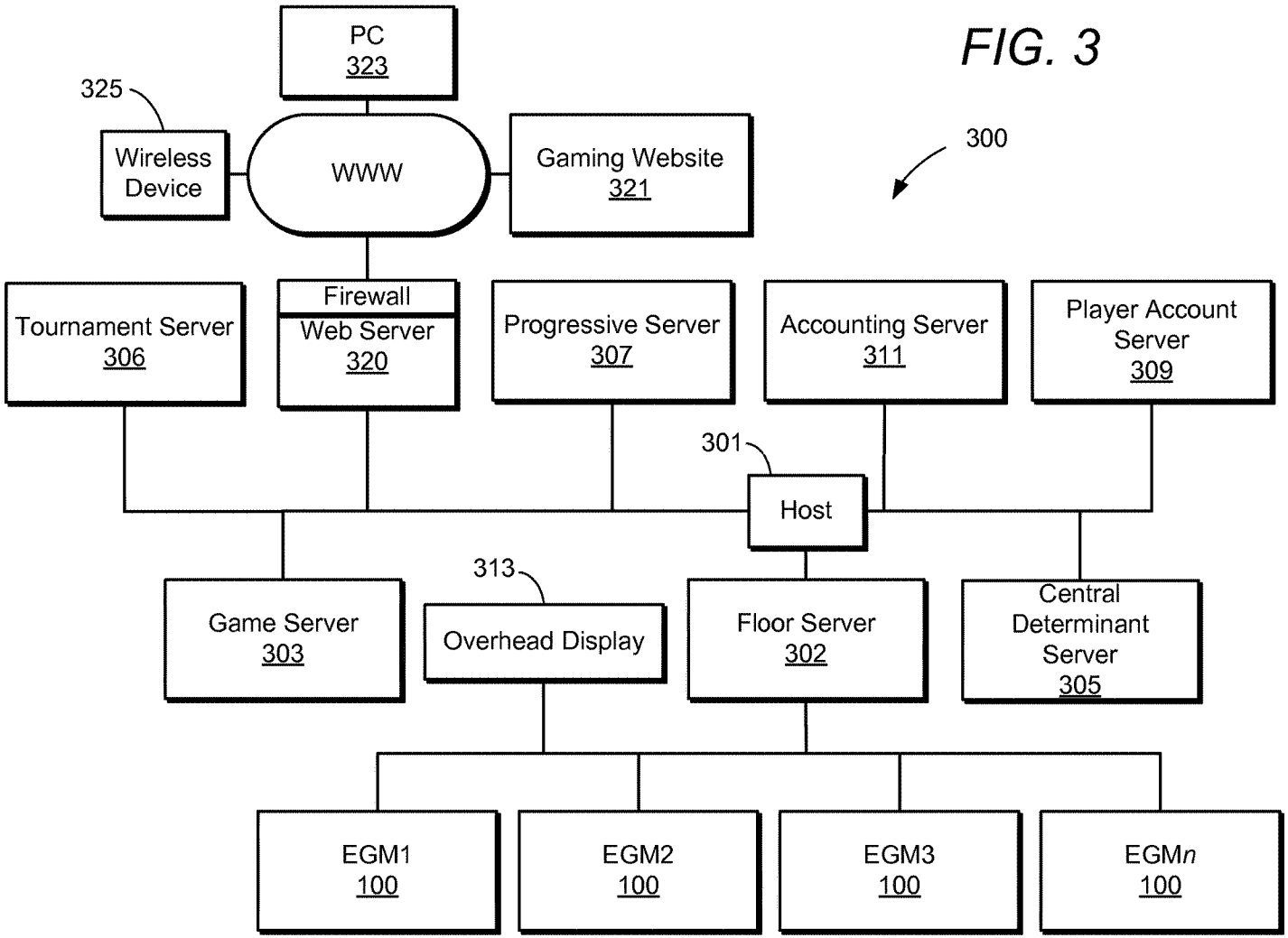
FIG. 3 is a diagrammatic representation of a gaming network in which the present invention may be implemented.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 (including a game play according to the present invention) may be transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the outcome information to networked gaming machines 100 which present the games to players.

Tournament server 306 may be included in the system for controlling or coordinating tournament functions. These functions may include maintaining tournament player scores and ranking in real time during the course of tournament play, and communicating this information to the various gaming machines 100 participating in the tournament. Tournament server 306 may also function to enroll players in tournaments, schedule tournaments, and maintain the time remaining in the various tournaments.

Progressive server 307 may maintain progressive pools for progressive games which may be available through the various gaming machines 100. In some implementations, progressive server 307 may simply receive communications indicating contribution amounts which have been determined by processes executing at the various gaming machines 100 or elsewhere in the gaming network. Alternatively, progressive server 307 may perform processes to determine the contribution amounts for incrementing the various progressive pools which may be maintained. Progressive server 307 may also periodically communicate current pool values back to the various gaming machines 100, and may participate in communicating awarded progressive prize amounts to the gaming machines and making adjustments to the progressive prize pools accordingly. In some implementations, progressive server 307 may also determine or participate in determining when a progressive prize triggering event occurs.

Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged in to website 321 the player may play various games on the website, including games according to the invention. Also website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network in which games featuring variable numbers of symbol location sets according to embodiments of the present invention may be implemented, and is not intended to be limiting in any way. The invention is not limited to use in games offered through a gaming network (via the gaming website 321, or via gaming machines such as gaming machines 100, or otherwise). For example, multiple symbol location set games according to the present invention may be offered through a stand-alone gaming machine having a configuration similar to gaming machine 100 or having any other gaming machine configuration. Also, where multiple symbol location set games as described herein are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

FIG. 4 comprises a process flow diagram showing an example process within the scope of the present invention. The process shown in FIG. 4 is particularly adapted to a gaming machine operating in a tournament mode to provide a tournament game. However the invention is not limited to tournament games as will be described further below.

The process shown in FIG. 4 is divided into the three separate sections indicated by three dashed boxes, boxes 400, 405, and 416. The portion of the process shown in dashed box 400 is associated with regular play of the tournament game in a base game state. Dashed box 405 shows a portion of the process relating to the activation of a tournament bonus input device and monitoring of that device. Dashed box 416 shows a portion of the process relating to operation of the gaming machine in the bonus game state.

Referring first to dashed box 400, the illustrated process includes initiating or starting the tournament as shown at start block 401. The process of starting a tournament may include a number of individual steps and initiation steps which are not relevant to the present invention and will therefore not be described in further detail.

As shown at process block 402, operation in the base game state includes receiving a play initiation input. This play initiation input may be received through a player input system of the gaming machine and may simply comprise a signal responsive to the player actuation of a "play" button or other control of the gaming machine. However, some forms of play in a base game state according to the invention may require multiple inputs by the player and these multiple inputs and the resulting signals may collectively represent a play initiation input received as shown at process block 402.

Regardless of the nature of the play initiation input, the gaming machine is operable to respond to that input to populate a base set of symbol locations as shown at process block 403. This populating step may comprise spinning the reels of the reel-type game, either actual mechanical reels or video simulated reels, or may include any suitable technique for displaying game symbols at the various symbol locations making up the base set of symbol locations. The pattern of game symbols shown in the base set of symbol locations after process block 403 corresponds to a result for the play initiation input received at process block 402. In the event the result for the play initiation input is associated with an award, the gaming machine also provides any such award as shown at process block 404. Providing an award in the context of a tournament game may include simply incrementing a point total or score for the player by the points or score corresponding to the result represented by the pattern of game symbols produced according to process block 403.

The operation in the base game state shown in dashed box 400 of FIG. 4 includes determining whether the tournament has ended as shown at block 406. This determination step may comprise any suitable process. For example, a given tournament may be operable for a predefined period of time and the gaming machine or an associated device may set a timer which counts down to the end of the tournament. The determination step in this case may include determining if the timer has counted down to zero. If the tournament has ended as indicated by an affirmative outcome at decision box 407, the illustrated process includes a tournament completion procedure as shown at process block 408. A number of steps may be included in this tournament completion procedure including displaying final results for the tournament and providing any awards for participation in the tournament based on the player's final rank or score or otherwise. If the tournament is not completed as indicated by a negative result at decision box 407, the process proceeds to the portion of the overall process shown at dashed box 405.

As shown at process block 410 in dashed box 405, the illustrated method includes determining if the tournament bonus input device is to be activated and then activating the device as necessary. The determination at this step may be made in any suitable manner within the scope of the present invention. In some preferred embodiments, the determination may be made randomly so that the tournament bonus input device is activated on average some predefined percentage of the inquiries. Additionally, the various gaming machines competing in a tournament may be controlled so that each gaming machine has the tournament bonus input device activated for an equal number of times or equal overall time. This normalization between gaming machines may be implemented through a processing device separate from the gaming machine such as tournament controller 306 in FIG. 3. Also, some forms of the invention may modify the determination step at process block 410 depending upon the point at which the inquiry is made over the course of the tournament game. For example, the determination for activating the tournament bonus input device may be suppressed for a predefined period of time at the start of tournament and/or for a predetermined period of time before the end of the tournament. In these cases, the determination step at process block 410 may include determining if the inquiry is within one of these suppression periods, and dictating a negative result for the inquiry if it is made within a suppression period. It will be noted that according to FIG. 4 a tournament is completed only in the portion of the process in dashed box 400. Thus in this illustrative example, the determination at process block 410 may be implemented to guarantee that the gaming machine is in the base game state at the completion of tournament such as for example by suppressing an activation of the tournament bonus input device if the period of time left in the tournament is less than a time at which the bonus game state may be active.

Regardless of the nature of the determination at process block 410, if the tournament bonus input device is not activated as indicated by a negative outcome at decision box 412, the process simply loops back to receive the next play initiation input in the base game state at process block 402. However, if the tournament bonus input device is activated as indicated by the affirmative outcome at decision box 412, the process proceeds to determine if the activated device has been actuated by a player as indicated by decision box 414. Thus, the illustrated process indicates that the activated tournament bonus input device must be actuated by the player by some affirmative action on the part of the player in order to place the gaming machine in the bonus game state. For example, and as will be described below in connection with the example game presentation of FIG. 6, the player may be required to actuate a control represented by the tournament bonus input device to produce an affirmative outcome at decision box 414. If the activated tournament bonus input device is not actuated, such as within a certain period of time after activation, the process includes deactivating the tournament of bonus input device as indicated by process block 415 and process again loops back to receive the next play initiation input at process block 402.

If the tournament bonus input device is actuated as indicated by an affirmative outcome at decision box 414, the process proceeds to the process steps shown in dashed box 416. In this illustrative example, this process includes transitioning to the bonus game state as indicated at process block 417. This transition may include modifying the display system in any of a number of different fashions within the scope of the present invention to show two or more bonus sets of game symbol locations. One example arrangement will be described in detail below in connection with FIG. 7, and includes modifying the display to show four separate sets of reels, each of which is operated to populate a respective set of game symbol locations with game symbols to show a respective result for the game. Other transitioning processes which may be performed at process block 417 will also be described below.

Once the gaming machine display system has been transitioned to the bonus game state to show the two or more bonus sets of game symbol locations, play in the bonus game state proceeds similarly to the base game state shown in dashed box 400. A play initiation input is received as indicated at process block 418, and, in response to the received play initiation input, the gaming machine is operated to populate each set of game symbol locations as shown at process block 420. However, because the game symbols shown in each separate bonus set of game symbol locations in the bonus game state each correspond to a respective result in the game for the play initiation input received at process block 418, the single play initiation input causes multiple different results to be displayed to the player, and each different result may be entitled to an award provided as indicated at process block 422. Thus it will be appreciated that in the bonus game state, the player has an opportunity to increase their number of winning results for each play initiation input they make.

The bonus game state process shown in dashed box 416 includes determining if the bonus game state should end as indicated at process block 423. This determination may made in any suitable manner. For example, some forms of the invention may place the gaming machine in the bonus game state for a limited period of time, and thus the determination at process block 423 is based on the passage of time. Alternatively, the bonus game state may be defined for a given number of play initiation inputs, and the determination at process block 423 involves tracking the number of play initiation inputs that have been received since the gaming machine was placed in the bonus game state. Regardless of how the determination is made, if the bonus game state does not end as indicated by a negative outcome at decision box 426, the process loops back to receive the next play initiation input in the bonus game state at process block 418. If the bonus game state is to end as indicated by an affirmative outcome at decision box 426 the process includes transitioning the display system back to the base game state as shown at process block 428 and then includes returning to receive the next play initiation input in the base game state at process block 402.

As noted above, embodiments of the present invention may be implemented in gaming machines employing general purpose processing devices executing program code. In some embodiments, the program code may include player input program code which is executable to receive player inputs such as at process blocks 402 and 418, and inputs to actuate an activated tournament bonus input device. Game program code may be executable for operations to facilitate play in the base game state in dashed box 400, facilitate activation and monitoring of the tournament bonus input device as shown in dashed box 415, and to facilitate play in the bonus game state as indicated in dashed box 416. Awarding program code may be included in the program product and may be executable for facilitating the awarding steps indicated at process blocks 404 and 422 in FIG. 4.

It should be noted that implementations of the invention may use any suitable technique for determining what game symbols are used to populate the various game symbol locations in both the base game state (at process block 403) and the bonus game state (at process block 420). Each reel or simulated reel may be controlled to stop at a random angular orientation about its rotational axis to show game symbols, or a result may be randomly determined and the reels controlled to stop to show that randomly determined result. The random determination of a result may be through a randomization algorithm or may be through drawing a result from a lottery set or obtaining a result from the play of a game such as bingo for example.

Figure 5:
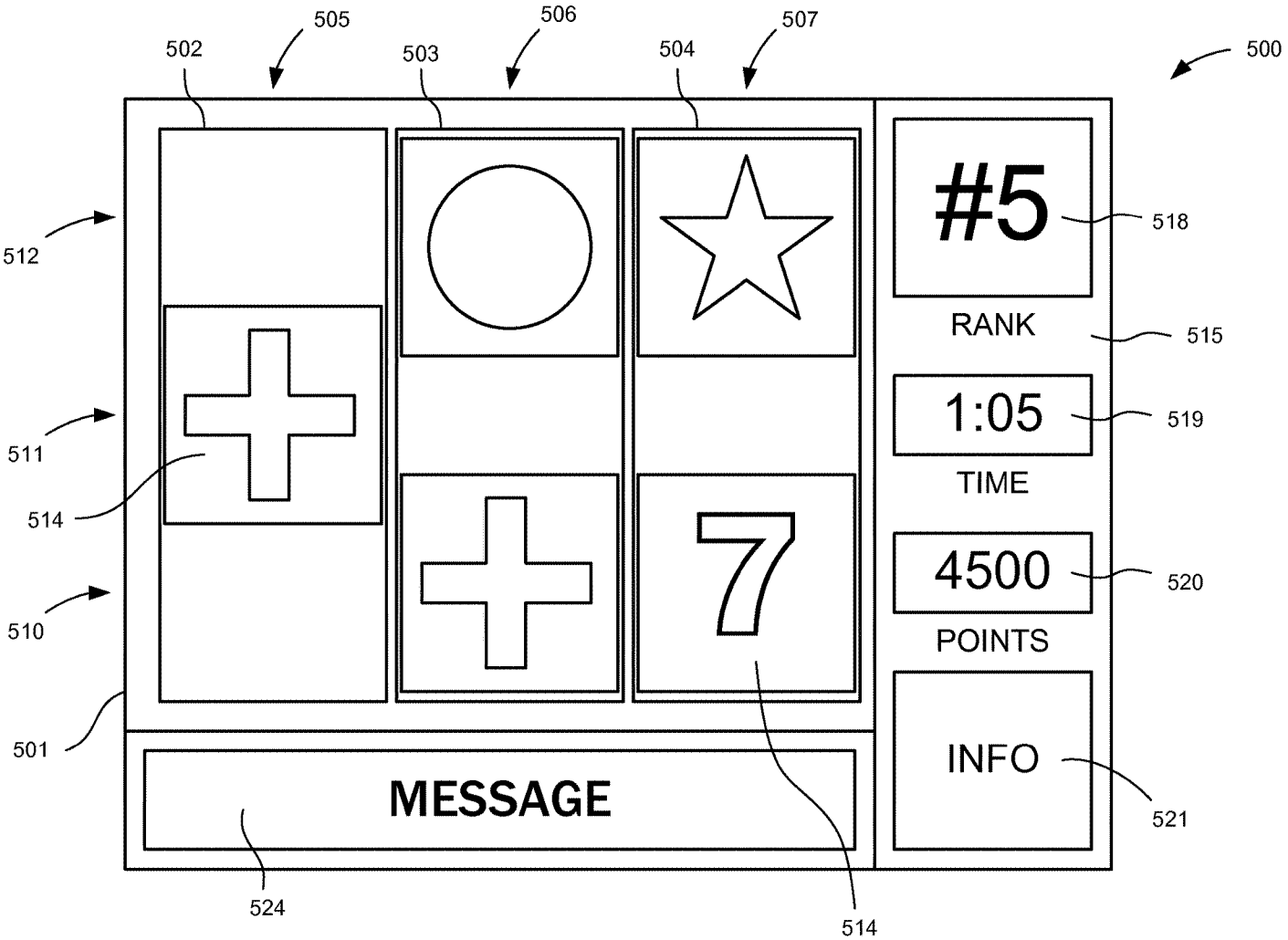
FIG. 5 is a representation of a game presentation shown on a display device for a base game state of a gaming machine according to one embodiment of the present invention.

FIGS. 5 through 8 may now be used to describe graphic presentations which are produced through a gaming machine display system according to a specific embodiment of the present invention. Referring to FIG. 5, a display system may be controlled to produce a graphic presentation 500 while the gaming machine is operating in the base game state. In this particular example, presentation 500 is produced on a video display device (such as display device 104 in FIG. 1) and includes a display area divided into three different areas. Display area 501 shows a reel simulation whereas display areas 515 and 524 are areas reserved for various information regarding play or otherwise. The reel simulation in display area 501 shows three simulated reels of a reel-type game, reels 502, 503, and 504. These three simulated reels define three columns 505, 506, and 507, and three rows 510, 511, and 512 of symbol locations. The symbol locations defined at every row and column intersection may be populated with various graphic symbols 514. Although reel-type games which may be displayed in embodiments of the invention are not limited to this particular arrangement, the illustrated reel-type game allows for one or two symbol locations to be displayed on each simulated reel depending upon where the reel stops spinning for the given play of the game. As shown in FIG. 5, where a game symbol such as the "plus" symbol lands in the middle row, row 511 for reel 502, the reel does not show game symbols in the adjacent rows 510 and 512. However, as indicated in both of reels 503 and 504 in FIG. 5, where the simulated reel stops with a game symbol (such as the "circle" game symbol on reel 503 and the "star" game symbol on reel 504) in the top row 512 of symbol locations, the respective reel also shows a game symbol occupying the lower row, row 510. Thus in this particular embodiment, each simulated reel stops to show a variable number of game symbols in the symbol locations, either one game symbol at the middle row 511 or two game symbols at the upper and lower rows 512 and 510 of each column. Again, embodiments of the invention are not limited to this reel-type game arrangement. Rather the invention encompasses any arrangement of reels, simulated or actual, and any number of visible symbol locations per reel for a given reel stop.

Regardless of the nature of the particular arrangement of game symbol locations for a given implementation of the present invention, it will be appreciated that the game symbols which populate the presentation after a spin of the reels corresponds to a result for that respective play of the game. That is, with reference to the flowchart of FIG. 4, the gaming machine receives a play initiation input at process block 402 in FIG. 4 and then the gaming machine is controlled to populate the game symbol locations for that set of game symbol locations (such as those shown in the area 501 FIG. 5), and the displayed game symbols correspond to a result for that play initiation input. Typically, the various awards for a given result are defined by a pay table as is well known in the field of reel-type gaming machines. Such a pay table is not shown for the hypothetical example game shown in FIGS. 5 through 8 since the present invention is not limited to any type of pay table and the details of the pay table itself form no part of the present invention.

Because the hypothetical reel-type game example shown in the figures is a tournament game, area 515 of the game presentation includes a display of various types of information associated with tournament play. For example, area 518 shows a rank of the player in the tournament. This rank, which may be displayed numerically as shown or in any other fashion, is preferably maintained in real time for tournament game implementations of the invention. A time remaining in the tournament is shown at area 519, and a score for the player in the tournament is shown in area 520. In this example the score is given in a numerical value of points accumulated over the course of the tournament. Area 515 also includes an additional area 521 for providing information which may or may not relate to the tournament.

Figure 6:
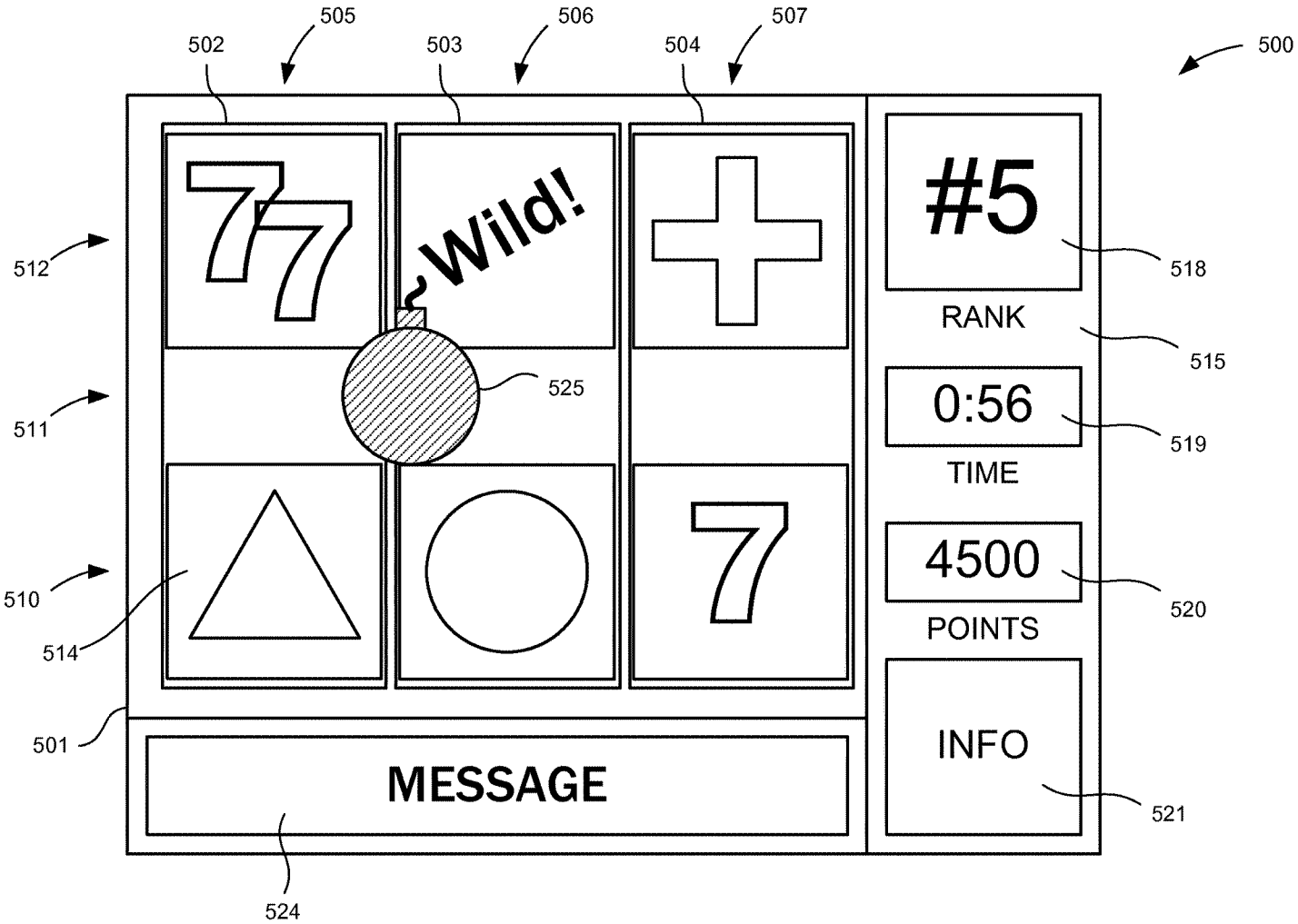
FIG. 6 is a representation of the game presentation shown in FIG. 5 after activation of a tournament bonus input device in accordance with an embodiment of the present invention.

FIG. 6 shows a state of game presentation 500 at a point in time after that shown in FIG. 5. It will be noted that the time remaining in the tournament shown in FIG. 6 is now at 56 seconds while the player's rank at number five and points remain the same. There has been at least one additional play initiation input which has caused the symbol location set in area 501 to be populated with a new group of game symbols 514 for that play initiation. Also, FIG. 6 shows that a bonus game initiation input device 525 has been activated. This activation corresponds to the step at process block 410 in FIG. 4. In this particular example, the device is activated by causing a special symbol (a cartoon bomb in this case) to be displayed on the display device of the gaming machine. This display of an input device special symbol may be accomplished in a number of fashions within the scope of the invention. For example, the special symbol may simply pop into existence on the display device and remain stationary, or it may be shown as entering the display area along one edge and traversing the display area across any or all of the areas 501, 515, and 524 until it ultimately leaves the display area. The time that the symbol is shown in the display area may correspond to a predetermined period for which the device is activated as indicated in the example process shown in FIG. 4. In any event, in this particular example the display device may comprise a touchscreen device and the player may actuate the tournament input device 525 simply by touching the device in the location it appears in the display area.

It will be appreciated that embodiments of the invention are not limited to this touchscreen type bonus game initiation input device. Alternative tournament bonus input devices may comprise simply one or more mechanical buttons or any other type of device which may be activated and which the player may actuate by touching, pressing, pulling, selecting (via some other interface), etc.

Figure 7:
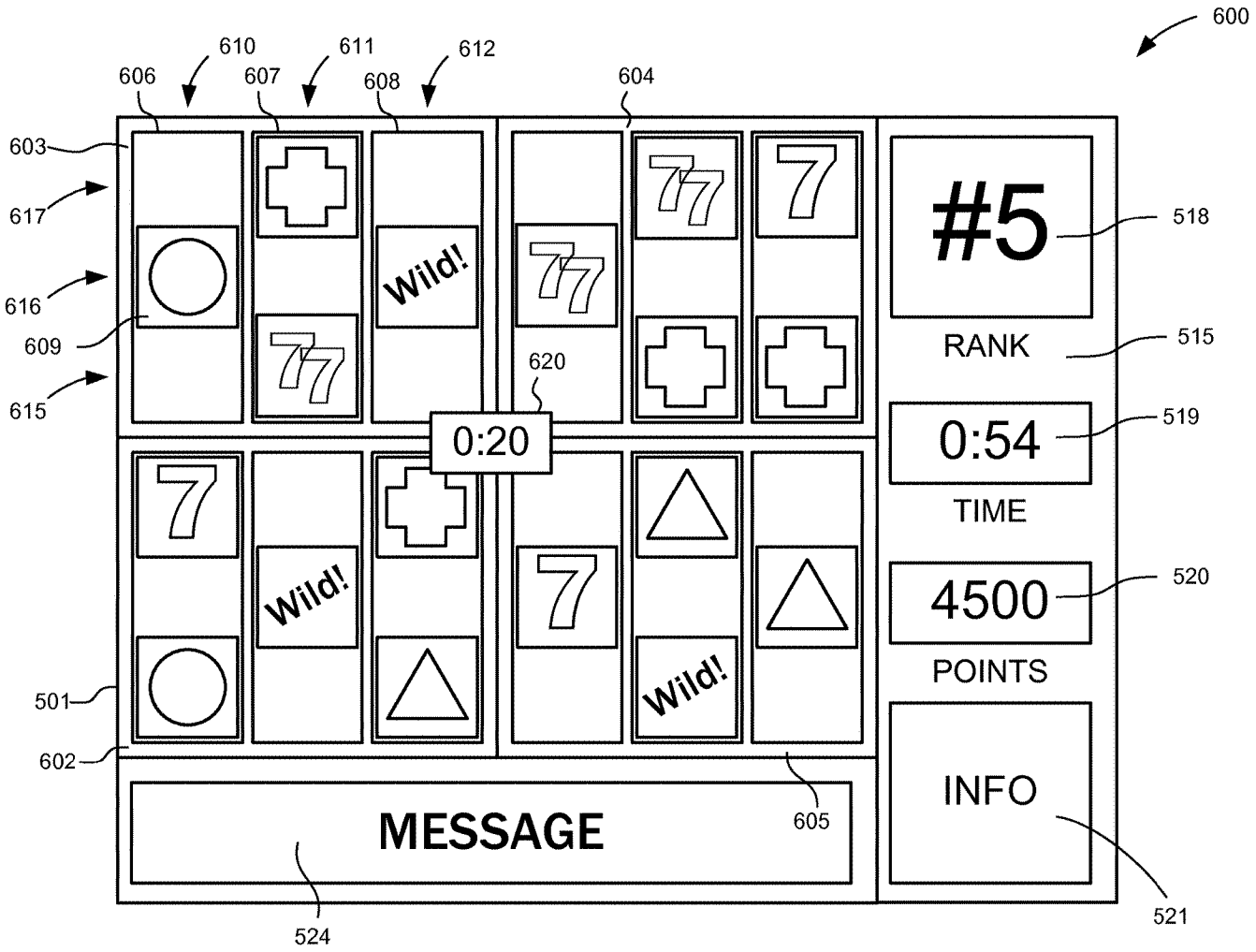
FIG. 7 is a representation of a game presentation shown on a display device after the gaming machine is transitioned to a bonus game state according to an embodiment of the invention.

FIG. 7 shows a game presentation 600 which may be displayed in the operation of the gaming machine in the bonus game state according to this specific embodiment of the invention. In this example, the display area 501 has, in response to the player actuation of device 525 in FIG. 6, transitioned to a graphic presentation showing four different bonus symbol location sets in four different areas 602, 603, 604, and 605. As shown in FIG. 7, the time remaining in the tournament has decreased by 2 seconds with respect to the point in time captured in FIG. 6. This passage of time represents the time required for the transition from the single set of symbol locations shown in area 501 in FIG. 6 to the multiple sets of symbol locations in area 501 shown in FIG. 7.

Each set of symbol locations in the example shown in FIG. 7 comprises simply a smaller version of the set of symbol locations shown in FIGS. 5 and 6 defined in each set by reels 606, 607, and 608, which define three columns 610, 611, 612 and three rows 615, 616, and 617 of symbol locations. The symbol locations are populated by game symbols 609 which are simply resized game symbols from the same game symbol set used to produce the game presentations shown in FIGS. 5 and 6. Thus in this example, each individual set of reels in the areas 602, 603, 604, and 605 are populated from the same game symbol set used to populate symbol location sets in the base game. It will be appreciated that other embodiments of the invention may use completely different types of game symbols for the bonus game or may include additional game symbols, or conceivably less game symbols than available for populating the various symbol locations in the base game state.

FIG. 7 also shows a countdown timer 620 which counts down the time remaining in the bonus game state in this embodiment. Thus this example embodiment assumes that the bonus game state is activated for a predetermined period of time, in this case 20 seconds. As noted above, and as will be appreciated by those skilled in the art, the invention is not limited to bonus game states defined for a predetermined period of time. Alternatively, the bonus game state may be invoked for a predetermined or variable number of play initiations or for a variable period of time, or in any other fashion. In any case, embodiments of the invention may or may not include a countdown device which keeps track of the time more activations remaining in the bonus game state.

FIG. 7 shows the reels of the different symbol location sets defined in areas 602, 603, 604, and 605 displaying game symbols which do not produce any winning result. Other embodiments may show the different reels spinning in the transition to presentation 600 and may award results associated with symbols which are ultimately displayed after the transition even though the player has not made another play initiation input at the gaming machine after actuating device 525 in FIG. 6. Still other forms of the invention may show a transition to presentation 600 which shows all of the reels blank or covered with non-game symbols at the start of the bonus game state or continuously spinning until the player enters an input which is received as indicated at process block 418 in FIG. 4.

Figure 8:
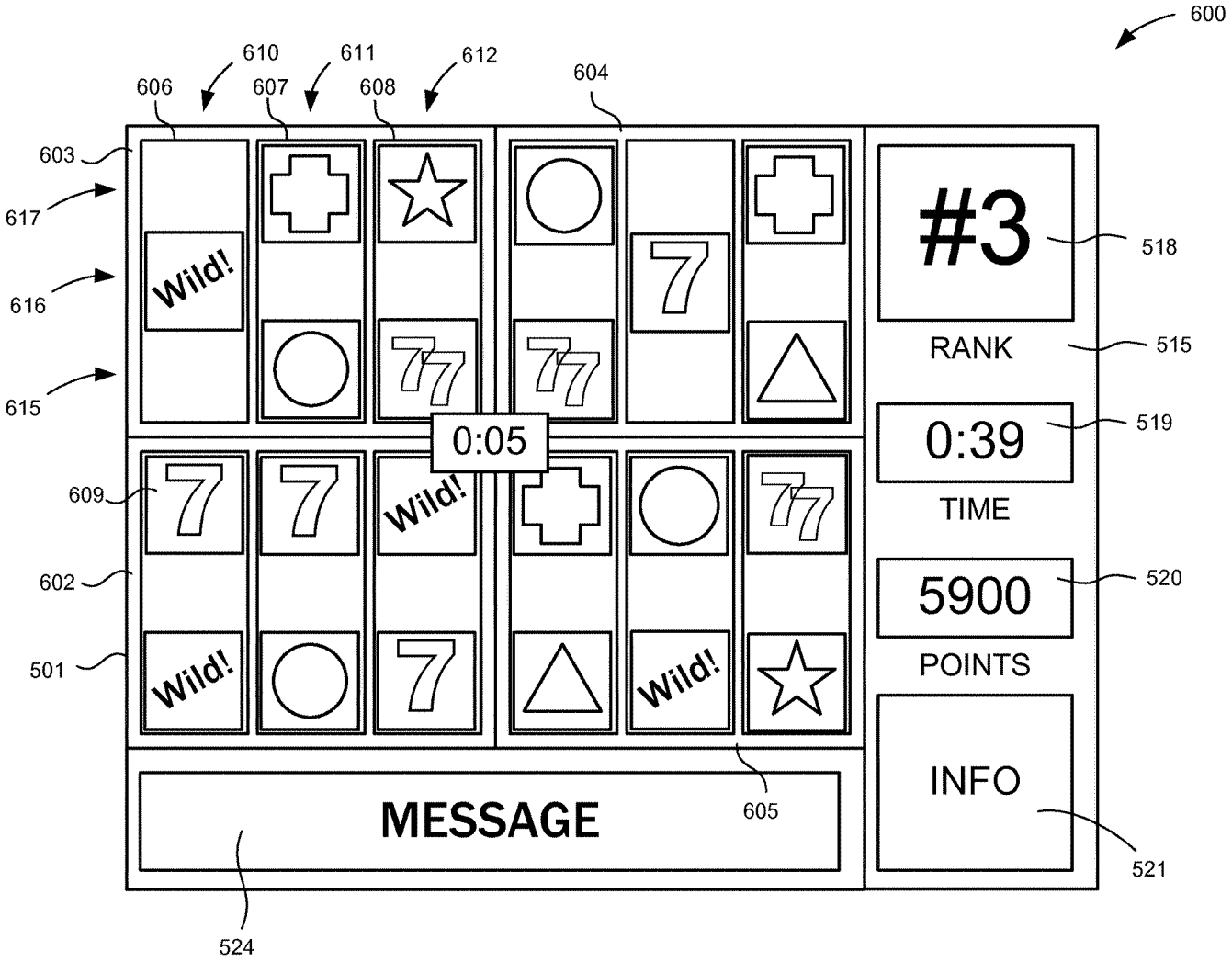
FIG. 8 is a representation of the game presentation shown in FIG. 7 at a point in time later in a predefined period of time for the bonus game state.

FIG. 8 shows a state of game presentation 600, the presentation for the bonus game state, at point in time 15 seconds after the state shown in FIG. 7. Thus the time remaining in the tournament it is shown as 39 seconds in area 519 and the time remaining in the bonus game state is shown as 5 seconds at countdown timer 620. It will be noted that the state of presentation 600 shown in FIG. 8 shows that the player's rank in the tournament has improved to third place at the display area 518 and the player's point total for the tournament has increased to 5900 points at display area 520.

Once the bonus game state ends according to the applicable rules for the bonus game state, the display showing presentation 600 will transition back to the presentation 500 as shown in FIGS. 5 and 6. This transition corresponds to the operation shown at process block 428 in FIG. 4 may include another spin of the reels (a single set of reels to define the base set of symbol locations) without any additional player input to show a non-winning game symbol arrangement or simply blank reels initially or reels showing nongame symbols. Of course when the player makes another play initiation input which is received as at process block 402 in FIG. 4, the display would be controlled again to populate the base game symbol location set with game symbols corresponding to a result for that play initiation input.

It will be appreciated that implementations which employ purely mechanical reels to show the various sets of game symbol locations for the base game and bonus game state do not have the option of resizing the reels and game symbols as indicated by the transition back and forth between presentations 500 and 600 in the above example. Where purely mechanical reels are used in implementations of the invention, a number of different reel sets corresponding to the highest number of bonus game sets of symbol locations available in the given implementation may be included in the gaming machine, however, only a single set of reels may be active for plays in the base game state. The other sets of reels which may be activated for a bonus game state within the scope of the invention may simply be inoperative for plays in the base game state. In this example using purely mechanical reels, the transition from base game state to bonus game state comprises simply activating one or more of the additional reel sets for play inputs received while the gaming machine is in the bonus game state. Transitioning back to the base game state may simply comprise deactivating lights for the additional reel sets or otherwise making the additional sets of reels inoperative for further play initiations, that is, initiations while the gaming machine is in the base game state. Of course, even where the reels are shown as video simulations for a given embodiment, both the set of reels for the base game state and the additional sets of reels for the bonus game state may always be displayed similarly to the mechanical arrangement and those additional sets of reels for the bonus game state may be grayed out or inoperative for play initiations while the gaming machine is in the base game state. The invention encompasses a number of variations on the process shown in FIG. 4 and described in connection with the presentations of FIGS. 5 through 8. For example, some embodiments of the invention may include a variable number of bonus game sets of symbol locations (variable number of reel sets) for the bonus game state. In these implementations, 2, 3, 4, or even more sets of symbol locations may be activated for the bonus game state, and the process may include a random or other determination as to the number of symbol location sets activated for a given bonus game state. The bonus input device in these embodiments may change to display the number of symbol location sets (reel sets) immediately after the player actuates the bonus input device prior to or during the transition to the display for the bonus game state. Regardless of the number of reel sets activated for a given play initiation input in the bonus game state, the reels are all preferably stopped at once.

Some embodiments of the invention may be controlled as indicated in FIG. 4 so that the bonus input device is not displayed while the gaming machine is in the bonus game state. Other embodiments may continue to include a step of determining whether to activate the bonus input device even while the gaming machine is in the bonus game state. In these implementations, a player actuation of the bonus input device while the gaming machine is already in the bonus game state may award the player additional time or additional play initiations (spins) in the bonus game state.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing actions, functions, characteristics, or features of multiple elements, and any such use of the term "each" is in the inclusive sense unless specifically stated otherwise. For example, if a claim defines two elements as "each" having a characteristic or feature, the use of the term "each" is not intended to exclude from the claim scope a situation having a third one of the elements which does not have the defined characteristic or feature.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A gaming machine including:

(a) a display system;

(b) a player input system; and (c) at least one processor operable to:

(i) in response to receipt of a respective one of one or more play initiation inputs through the player input system while the gaming machine is in a base game state of a tournament game, causing the display system to populate a base set of symbol locations with game symbols, the displayed game symbols for the respective play initiation input corresponding to a respective result in the tournament game for the respective play initiation input, (ii) activate a tournament bonus input device on the gaming machine while the gaming machine is in the base game state of the tournament game, (iii) place the gaming machine in a bonus game state in response to a player actuation of the activated tournament bonus input device, (iv) in response to a play initiation input through the player input system while the gaming machine is in the bonus game state, cause the display system to populate two or more bonus game sets of symbol locations with game symbols for that respective play initiation input, the game symbols in each bonus set of symbol locations corresponding to a respective result in the tournament game for the respective play initiation input, and (v) provide an award corresponding to each result in the game for a respective play initiation input in the tournament game.

2. The gaming machine of claim 1 wherein the tournament bonus input device is activated responsive to a random selection process.

3. The gaming machine of claim 2 wherein the at least one processor is also operable to suppress activation of the bonus input device at a predefined time period of an overall time period for the tournament game.

4. The gaming machine of claim 1 wherein the at least one processor is also operable to:

(a) activate the tournament bonus input device for a predefined activation period; and (b) deactivate the tournament bonus input device in response to the first to occur of either the player actuation of the activated tournament bonus input device or a lapse of the predefined activation period.

5. The gaming machine of claim 4 wherein:

(a) the tournament bonus input device comprises a tournament bonus input symbol displayed by the display system; and (b) the at least one processor is operable to activate the tournament bonus input device by causing the display system to display the tournament bonus input symbol in a display area of the display system so as to be visible only during the predefined activation period.

6. The gaming machine of claim 1 wherein the at least one processor is operable to cause the display system to replace the base set of symbol locations with the two or more bonus game sets of symbol locations.

7. The gaming machine of claim 1 wherein the at least one processor is operable to place the gaming machine in the bonus game state for a predefined bonus period and to place the gaming machine back in the base game state in response to completion of the predefined bonus period.

8. A method including:

(a) receiving one or more play initiation inputs through a player input system of a gaming machine while the gaming machine is in a base game state of a tournament game, and, in response to a respective one of the one or more play initiation inputs while the gaming machine is in the base game state, causing a display system of the gaming machine to, under control of a data processing system, populate a base set of symbol locations with game symbols, the displayed game symbols for the respective play initiation input corresponding to a respective result in the tournament game for the respective play initiation input;

(b) under control of the data processing system while the gaming machine is in the base game state of the tournament game, activating a tournament bonus input device on the gaming machine;

(c) in response to a player actuation of the activated tournament bonus input device, and under control of the data processing system, placing the gaming machine in a bonus game state;

(d) in response to a play initiation input received through the player input system while the gaming machine is in the bonus game state, and under control of the data processing system, causing the display system to populate two or more bonus game sets of symbol locations with game symbols for that respective play initiation input, the game symbols in each bonus set of symbol locations corresponding to a respective result in the tournament game for the respective play initiation input; and (e) under control of the data processing system, providing an award corresponding to each result in the game for a respective play initiation input in the tournament game.

9. The method of claim 8 wherein the tournament bonus input device is activated responsive to a random selection process.

10. The method of claim 9 further including suppressing activation of the bonus input device at a predefined time period of an overall time period for the tournament game.

11. The method of claim 8 wherein:

(a) activating the tournament bonus input device includes activating the tournament bonus input device for a predefined activation period; and (b) further including deactivating the tournament bonus input device in response to the first to occur of either the player actuation of the activated tournament bonus input device or a lapse of the predefined activation period.

12. The method of claim 11 wherein:

(a) the tournament bonus input device comprises a tournament bonus input symbol displayed by the display system; and (b) activating the tournament bonus input device includes causing the display system to display the tournament bonus input symbol in a display area of the display system so as to be visible only during the predefined activation period.

13. The method of claim 8 wherein placing the gaming machine in the bonus game state includes causing the display system to replace the base set of symbol locations with the two or more bonus game sets of symbol locations.

14. The method of claim 8 wherein the gaming machine is placed in the bonus game state for a predefined bonus period and the method further includes placing the gaming machine back in the base game state in response to completion of the predefined bonus period.

15. A program product comprising one or more non-transitory computer readable data storage devices storing program code, the program code including:

(a) player input program code executable by at least one processor to receive signals from a player input system representing a respective play initiation input of a gaming machine;

(b) game program code executable by the at least one processor to, (i) in response to receipt of a respective one of one or more play initiation inputs through the player input system while the gaming machine is in a base game state of a tournament game, cause a display system of the gaming machine to populate a base set of symbol locations with game symbols, the displayed game symbols for the respective play initiation input corresponding to a respective result in the tournament game for the respective play initiation input, (ii) activate a tournament bonus input device on the gaming machine while the gaming machine is in the base game state of the tournament game, (iii) place the gaming machine in a bonus game state in response to a player actuation of the activated tournament bonus input device, (iv) in response to receipt of a play initiation input through the player input system while the gaming machine is in the bonus game state, cause the display system to populate two or more bonus game sets of symbol locations with game symbols for that respective play initiation input, the game symbols in each bonus set of symbol locations corresponding to a respective result in the tournament game for the respective play initiation input, and (c) awarding program code executable by the at least one processor to provide any award indicated by the tournament game results.

16. The program product of claim 15 wherein the tournament bonus input device is activated responsive to a random selection process.

17. The program product of claim 16 wherein the game program code is also executable to suppress activation of the bonus input device at a predefined time period of an overall time period for the tournament game.

18. The program product of claim 15 wherein the game program code is executable to:

(a) activate the tournament bonus input device for a predefined activation period; and (b) deactivate the tournament bonus input device in response to the first to occur of either the player actuation of the activated tournament bonus input device or a lapse of the predefined activation period.

19. The program product of claim 18 wherein:

(a) the tournament bonus input device comprises a tournament bonus input symbol displayed by the display system; and (b) the game program code is executable to activate the tournament bonus input device by causing the display system to display the tournament bonus input symbol in a display area of the display system so as to be visible only during the predefined activation period.

20. The program product of claim 15 wherein the game program code is executable to place the gaming machine in the bonus game state for a predefined bonus period and to place the gaming machine back in the base game state in response to completion of the predefined bonus period.

* * * * *